United States Patent [19]

Taylor

[11] 4,426,676

[45] Jan. 17, 1984

[54] LUMINAIRE MOUNTING

[75] Inventor: Carl D. Taylor, Hendersonville, N.C.

[73] Assignee: General Electric Company, Schenectady, N.Y.

[21] Appl. No.: 446,807

[22] Filed: Dec. 3, 1982

[51] Int. Cl.[3] ..... F21P 5/00

[52] U.S. Cl. ..... 362/371; 362/396; 362/428; 362/431

[58] Field of Search ..... 362/396, 371, 428, 431

[56] References Cited

U.S. PATENT DOCUMENTS

| | | | |
|---|---|---|---|
| 3,072,783 | 1/1963 | Harling | 362/382 |
| 3,086,107 | 4/1963 | Grover | 362/371 |
| 3,142,501 | 7/1964 | Clark et al. | 362/396 |
| 3,184,199 | 5/1965 | Clark et al. | 248/230 |
| 3,297,864 | 1/1967 | Waldbauer | 240/25 |
| 3,328,575 | 6/1967 | Waldbauer | 240/25 |
| 3,530,287 | 9/1970 | Husby | 362/267 |
| 3,652,047 | 3/1972 | Starr | 248/230 |
| 3,965,346 | 6/1976 | Thompson, Jr. | 362/371 |
| 4,194,237 | 3/1980 | Conklin | 362/418 |
| 4,363,086 | 12/1982 | Fletcher | 362/371 |

*Primary Examiner*—Stephen J. Lechert, Jr.
*Assistant Examiner*—Howard J. Locker
*Attorney, Agent, or Firm*—Ernest W. Legree; Philip L. Schlamp; Fred Jacob

[57] ABSTRACT

A luminaire having a slipfitter mounting for adjustably clamping a pipe support. The slipfitter comprises a yoke member which engages the underside of the pipe, and a transverse pivot rib forming part of the upper housing which engages the topside of the pipe. The yoke is pressed against the pipe by two pairs of bolts, one to the front and the other to the rear of the pivot rib, and these bolts are adjusted for leveling and clamping. Bosses with cored holes are cast in the housing to accommodate the bolts which are of thread-forming type.

4 Claims, 3 Drawing Figures

LUMINAIRE MOUNTING

The invention relates to an adjustable mounting arrangement or slipfitter for a luminaire.

BACKGROUND OF THE INVENTION

Luminaires of the type commonly used for street lighting comprise an elongated housing containing a lamp, a reflector and a refractor at the front end, and a mounting device known as the slipfitter at the rear end. The slipfitter receives and clamps a generally horizontal pipe support in a manner allowing adjustable mounting of the luminaire. General desiderata in slipfitter design are adaptability to various pipe sizes, adjustability with a minimum number of parts, ease of assembly at the factory and convenience in installation and adjustment in the field, combined of course with low cost.

SUMMARY OF THE INVENTION

One object of the invention is to provide a slipfitter which allows leveling and will accommodate a range of pipe sizes without any need for disassembly, rearrangement, or reversal of parts in the field. Ordinary pipe of nominal sizes 1¼" and 2" has an outer diameter going from 1⅝" to 2⅜" and it is desired to overlap this range.

Another object is to provide a slipfitter clamp design which can be completely assembled from one side of the luminaire housing without the need to turn the housing over during manufacture, such being desirable to speed assembly and reduce manufacturing costs.

Other objects and advantages will become apparent from this summary and the detailed description and appended claims following.

In accordance with the invention, the slipfitter comprises yoke means for engaging either the underside or the topside of an elongated support member such as a pipe, and a transverse pivot rib as part of the housing for engaging the opposite side of the support member. The yoke means are adapted to engage the support member at two places longitudinally spaced on each side of the pivot rib. Means are provided for adjustably pressing the yoke means against the support member at those two places in order to level the luminaire and clamp the support member.

In one embodiment, a yoke engages the underside of the support pipe and the pivot rib is part of the upper housing and engages the topside of the pipe. The yoke is pressed against the support pipe by two pairs of bolts, one pair to the front and the other pair to the rear of the pivot rib. In order to level the luminaire, it is rocked on the pivot rib by adjustment of the bolts, as by tightening one pair of bolts while loosening the other pair.

In a preferred embodiment, auxiliary ribs located to the front and to the rear of the pivot rib serve as limit stops for the range of leveling possible. In order to make possible the bolt travel needed for the leveling range and for adjusting to the various pipe sizes accommodated, cored holes are preferably provided when the luminaire housing is cast. The cored holes accommodate four bolts which clamp the yoke and are broached if necessary to allow the use of thread-forming bolts.

DETAILED DESCRIPTION

Figure 1:
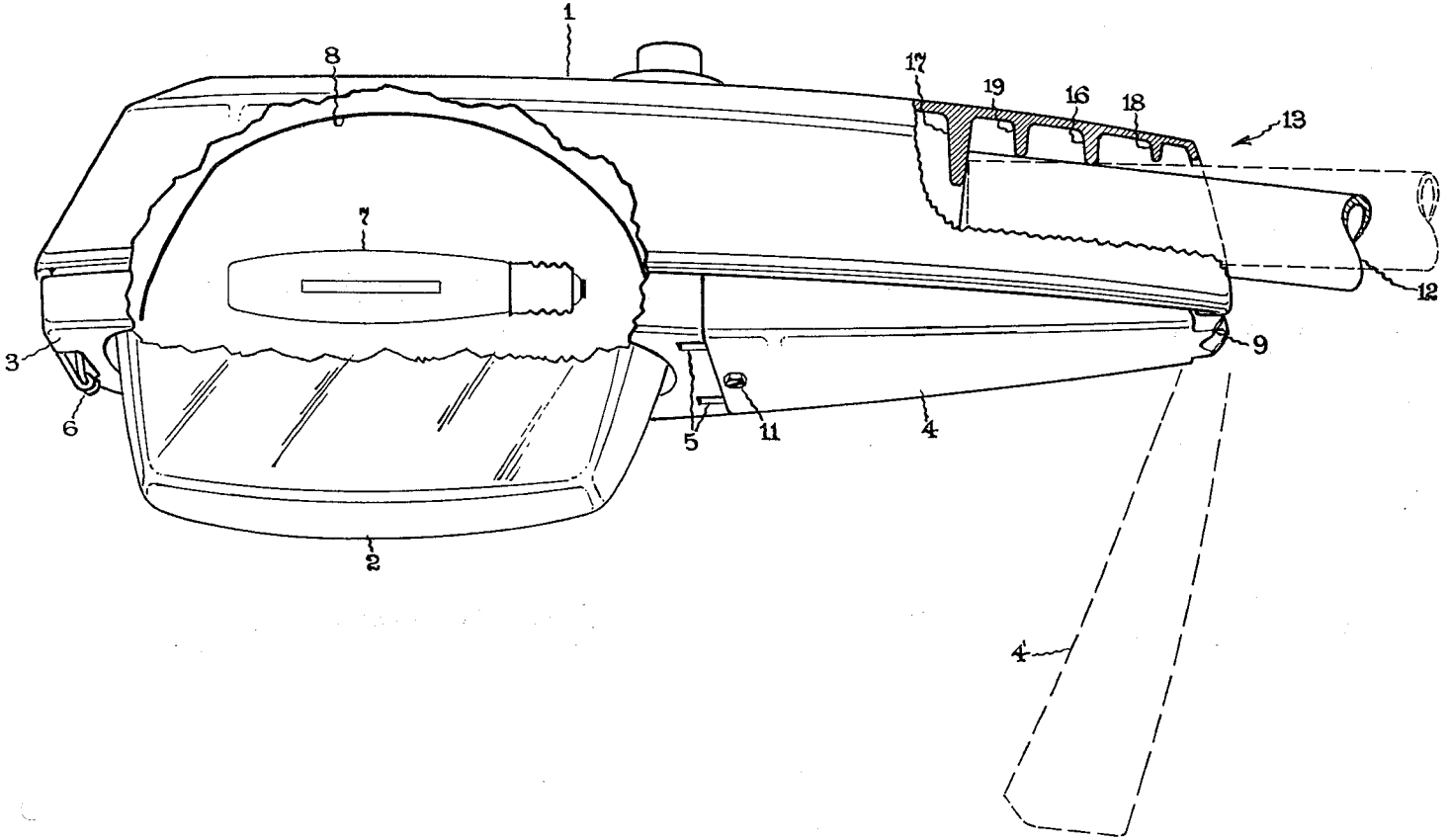
FIG. 1 is a pictorial view, partly broken away, of a street lighting luminaire comprising the slipfitter mounting of the invention.
Figure 2:
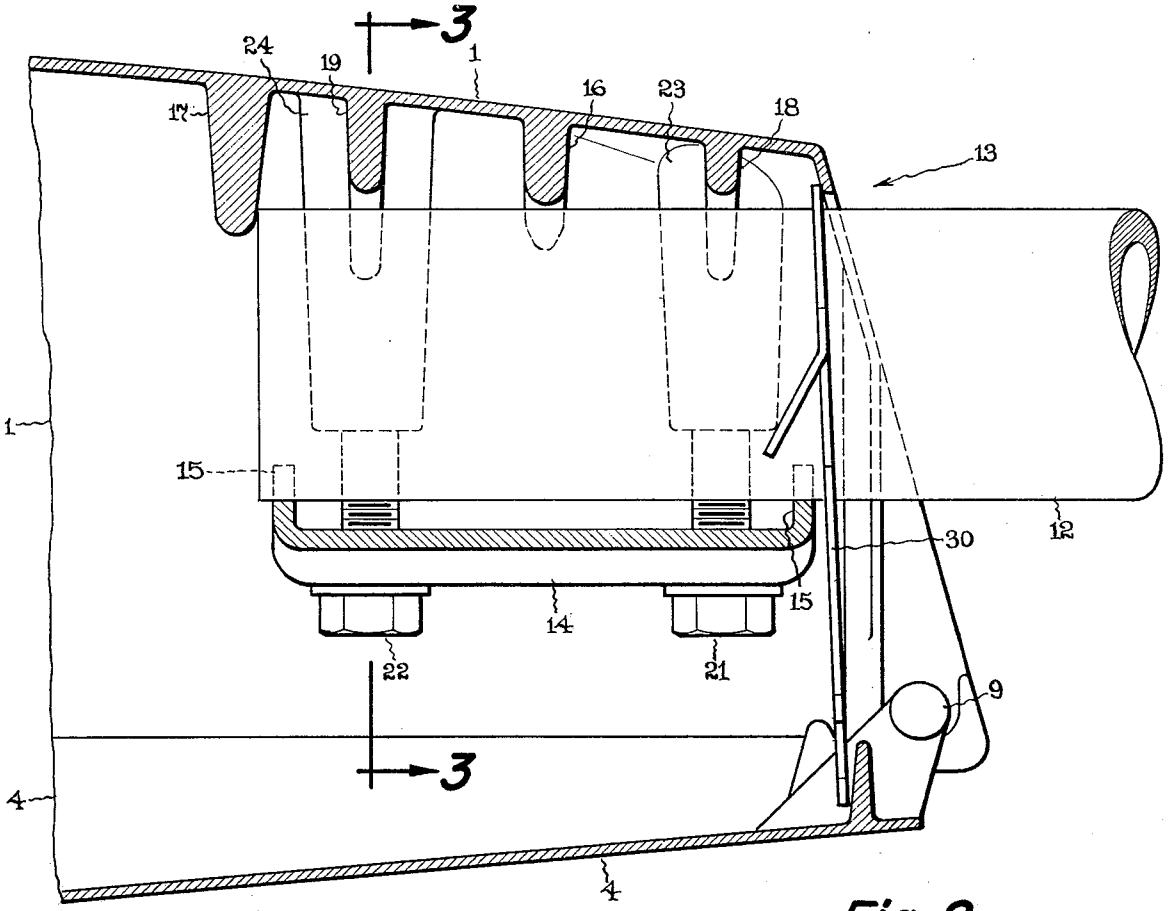
FIG. 2 is a sectioned detailed view in side elevation of an adjustable slipfitter embodying the invention.
Figure 3:
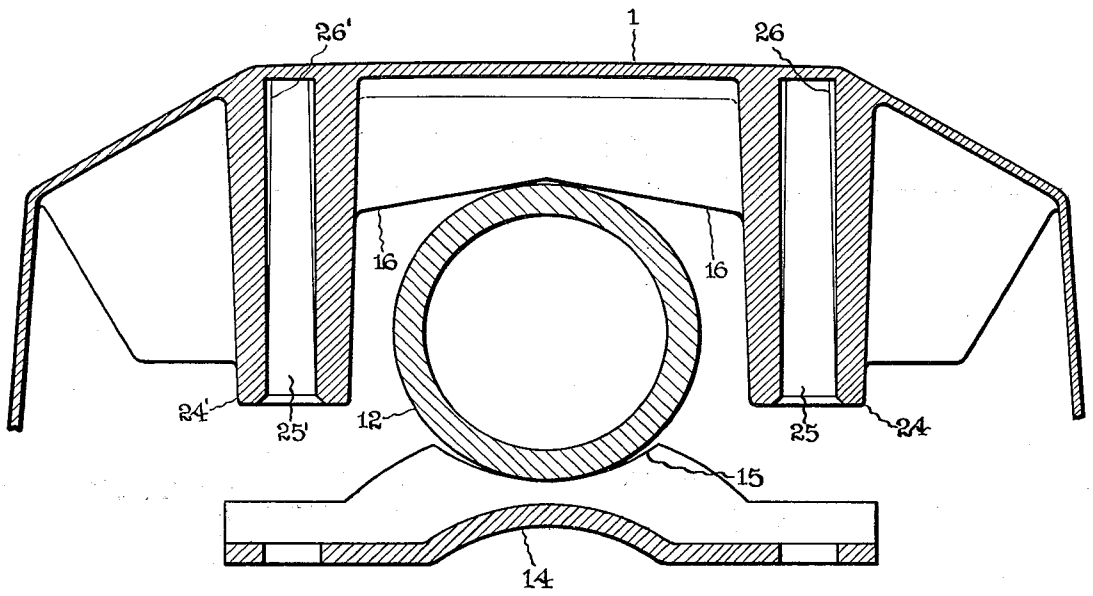
FIG. 3 is a cross sectional view of portions of the slip fitter mounting as seen looking in the direction of the arrow 3—3 in FIG. 2.

Referring to the drawings and particularly to FIG. 1, the illustrated street lighting luminaire comprises an upper housing 1 whose underside is closed at the front by a refractor 2 supported in a frame member 3, and at the rear by a door 4. The housing may be an aluminum casting of conventional thickness, suitably .065" to .075". The frame member is hinged at 5 and may be swung down by releasing over-center latch 6 to give access to the high intensity discharge lamp 7 and to the reflector 8 above it. Door 4 is attached by captivating hinge 9 to the rear end of housing 1 (see also FIG. 2) so as to be swingable downwardly to the position shown in dash lines in FIG. 1. With door 4 in its open position, access is readily had to the rear interior portion of housing 1, to the ballast components (not shown) for operating the lamp, and at the very back, to the slipfitter parts therein as shown in FIGS. 2 and 3. The ballast components may be fastened to the inside of the door, an arrangement which facilitates changeouts by replacing the entire door. The front end of door 4 is releasably attached to housing 1 by a screw 11 to retain the door in closed position. The present luminaire is described by way of example and it will be understood that the slipfitter of the invention may be embodied in other types of luminaires or lighting fixtures constructed differently from that shown.

The luminaire housing has an opening at its rear end for receiving an elongated support member such as a tubular bracket or pipe 12 which may extend generally horizontally from a pole or other vertical support. The luminaire is mounted on the support pipe by the slipfitter arrangement 13 of the invention which also provides for adjustment of the luminaire housing 1 about its longitudinal axis (extending along the longitudinal axis of pipe 12). The slipfitter also provides adjustment about a horizontal axis normal to the longitudinal axis through a limited range for leveling purposes, as more fully described below.

As shown in FIGS. 2 and 3, the slipfitter arrangement 13 comprises yoke means in the form of a single yoke member 14 which is U-shaped in longitudinal section as shown in FIG. 2 and arched for strength. It has end walls 15 which are concave upward with a radius at least as large as that of the maximum size of pipe to be accommodated. For instance, in the illustrated example designed to accommodate nominal pipe sizes of 1¼", 1⅝" and 2" whose O.D.'s are 1⅝", 2" and 2⅜" respectively, a radius of 1 3/16" is used. This results in a centering action by the yoke on the pipe as the yoke presses the pipe up against transverse rib 16 in the housing which serves as a pivot. The rib has sloping sides making an included angle of about 160° as seen in FIG. 3. This results in a two point contact of the pipe against the rib. The single point contact of each end wall 15 of the yoke on the underside of the pipe combined with the two point contact of pivot rib 16 on the topside of the pipe provides a stable and secure clamping action.

The support pipe 12 penetrates the housing up to cast boss 17 which serves as a stop. The luminaire can, of course, be turned about the projected axis of the support pipe as a longitudinal axis, and is normally oriented in attitude to direct its light down. The pipe support is nominally horizontal but to compensate for the departures inevitably encountered in practice, it is desirable for leveling purposes to be able to rock the luminaire through a small angle about a horizontal axis transverse to the longitudinal axis. In the present example, a leveling adjustment of ±5° is provided. Auxiliary rib 18 serves as a limit stop to upward tipping, while auxiliary rib 19 serves as the limit stop to downward tipping as shown in FIG. 2. In transverse view, ribs 18 and 19 are concave downward with a radius of $1\frac{5}{8}''$ assuring single point contact at the limits. Leveling is accomplished by tightening the rear set of bolts 21 until the desired inclination of the luminaire housing is attained and then tightening the front set 22 to lock in the adjustment. It will be understood that in lieu of a single yoke member 14, the yoke means may take the form of two separate yoke members one under each set of bolts.

In order to have the adjustments needed for leveling and for accommodating the various pipe sizes, the four bolts 21, 22 must be able to penetrate a considerable distance into the dependent bosses 23, 24 cast in the luminaire housing for receiving them. No matter what the depth of penetration, there must be adequate engagement of the screw threads in the bosses. It is preferred to use thread-forming bolts or screws. In thread-forming, by contrast with thread-cutting, the material of the bosses (aluminum) is simply displaced to form the threads and nothing is removed. Accordingly, it is necessary that the hole diameter range required by the bolt or screw be accurately maintained throughout the entire depth of penetration.

A hole formed by using a core pin in a boss as cast is known as a cored hole. It is necessary to have a slight taper in the pin to permit its withdrawal from the boss after casting. The result is a corresponding taper in the hole, as may be seen in holes 25, 25' in FIG. 3. The depth of bolt travel needed may make it impossible to maintain the hole diameter required for a thread forming bolt throughout the depth of the hole. Usually this would mean that the entire hole must be drilled out to the required size. I have found that one may use a cored hole size which is very close to the ultimate hole diameter required by the thread forming bolt. The slight amount of extra material which needs to be removed is only a few thousandths of an inch per side, as indicated in exaggerated fashion at 26, 26'. The extra material can be removed by a simple broaching tool during the trimming operation on the casting. Then by using thread forming bolts 21, 22 suitably of steel for working in an aluminum casting, no machining or threading or other operations of a similar nature are required on the luminaire housing after it has been cast and trimmed.

The invention thus provides an improved luminaire slipfitting mounting which is readily and economically assembled from one side without ever requiring the housing to be turned over. It is adaptable to a range of pipe support sizes without use of adaptor parts, and is easily adjustable from inside the luminaire for tilting or tipping about a transverse or longitudinal axis to a desired attitude. The dash line showing of the pipe in FIG. 1 represents a different inclination adjustment.

A birdshield 30 may be used to close off the rear of the luminaire, as shown in FIG. 2. Reference may be made to my co-pending application Ser. No. 446,809, filed of even date herewith, titled Luminaire Birdshield and assigned to same assignee as the present invention, for a complete description thereof.

While the invention has been described with reference to a particular embodiment thereof in the form of a street or roadway luminaire, it will be understood that various modifications may be made by those skilled in the art without departing from the invention. To mention but the most obvious, the luminaire construction may be reversed to put the pivot rib under the support pipe and the yoke member on top, in which case access to the bolts would be by a door in the topside of the housing. The appended claims are intended to cover all such equivalent variations coming within the true spirit and scope of the invention.

What I claim as new and desire to secure by Letters Patent of the United States is:

1. A luminaire comprising an upper housing having a longitudinal axis and containing a slipfitter at the rear thereof for clamping onto a support member of a size overlapping the range of about $1\frac{5}{8}''$ O.D. to about $2\frac{3}{8}''$ O.D. in a manner allowing adjustable mounting of the luminaire without substitution or reversal of parts, said slipfitter comprising yoke means for engaging the underside of the support member and a transverse pivot rib in said housing for engaging the topside side of the support member, said yoke means being adapted to engage the support member at two places longitudinally spaced on each side of the pivot rib, and means for adjustably pressing the yoke means against the support member at said two places in order to rock the luminaire on the pivot rib for leveling purposes and in order to clamp the support member throughout said size range, comprising four thread-forming bolts paired on each side of the pivot rib and on each side of the support member, and cast bosses depending from the housing, said bosses having cored holes sized to accommodate the bolts to the depth of penetration required for leveling and clamping throughout said size range.

2. A luminaire as in claim 1 wherein said pivot rib as seen in transverse view has sloping sides for making a two-point contact with the support member.

3. A luminaire as in claim 2 wherein said yoke means is a U-shaped member with end walls which are concave upwards as seen in transverse view with a radius of curvature at least as large as that of the maximum size of pipe accommodated in the slipfitter.

4. A luminaire as in claim 2 including auxiliary ribs on each side of the pivot rib forming integral parts of the upper housing and serving as limit stops in leveling the luminaire on the support member.

* * * * *